US011274509B2

(12) United States Patent
Do et al.

(10) Patent No.: US 11,274,509 B2
(45) Date of Patent: Mar. 15, 2022

(54) ADJUSTABLE PIPE HANDLING SYSTEM

(71) Applicant: Nabors Drilling Technologies USA, Inc., Houston, TX (US)

(72) Inventors: David Do, Tomball, TX (US); Travis Burke, Spring, TX (US); Geoffrey Fletcher, Tomball, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 17/091,936

(22) Filed: Nov. 6, 2020

(65) Prior Publication Data

US 2021/0156207 A1 May 27, 2021

Related U.S. Application Data

(60) Provisional application No. 62/941,253, filed on Nov. 27, 2019.

(51) Int. Cl.
*E21B 19/15* (2006.01)

(52) U.S. Cl.
CPC ..... *E21B 19/155* (2013.01)

(58) Field of Classification Search
CPC ..... E21B 19/15; E21B 19/155; E21B 19/14; E21B 19/20; E04F 11/02; E04F 2011/005; E04F 2011/007; B63B 27/143
USPC ..... 414/22.51–22.71
See application file for complete search history.

(56) References Cited

U.S. PATENT DOCUMENTS

| | | | | |
|---|---|---|---|---|
| 4,943,048 | A | 7/1990 | Hentges | |
| 6,389,629 | B1 | 5/2002 | Schouest | |
| 6,526,614 | B2 * | 3/2003 | Anderson | E01C 9/083 14/69.5 |
| 6,827,543 | B2 * | 12/2004 | O'Neil | B60P 3/07 414/537 |
| 7,240,388 | B2 * | 7/2007 | Warford | A61G 3/061 14/69.5 |
| 7,404,697 | B2 | 7/2008 | Thompson | |
| 8,764,368 | B2 | 7/2014 | Crossley et al. | |
| 9,518,432 | B2 * | 12/2016 | Miranda | E21B 19/155 |
| 2006/0104746 | A1 | 5/2006 | Thompson | |
| 2006/0285941 | A1 * | 12/2006 | Fikowski | E21B 19/155 414/22.54 |
| 2018/0179836 | A1 | 6/2018 | Ferrari | |
| 2019/0145192 | A1 | 5/2019 | Rios | |

FOREIGN PATENT DOCUMENTS

| | | | |
|---|---|---|---|
| EP | 0391870 | B1 | 10/1993 |
| WO | 2009/094765 | A1 | 8/2009 |

OTHER PUBLICATIONS

International Search Report from PCT/US2020/059505 dated Feb. 26, 2021, 1 pg.

* cited by examiner

*Primary Examiner* — Lynn E Schwenning

(74) *Attorney, Agent, or Firm* — Abel Schillinger, LLP; Enrique Abarca

(57) ABSTRACT

A pipe handling system for transporting pipe between a horizontal storage location and a rig floor, where the pipe handling system can include an adjustable length ramp assembly which can be adjusted by installing one or more extension sections between bottom and top sections The sections can include interfacing features that can align the sections with each other when they are attached together in the ramp assembly.

19 Claims, 15 Drawing Sheets

ADJUSTABLE PIPE HANDLING SYSTEM

CROSS-REFERENCE TO RELATED APPLICATION(S)

This application claims priority under 35 U.S.C. § 119(e) to U.S. Patent Application No. 62/941,253, entitled "ADJUSTABLE PIPE HANDLING SYSTEM," by David Do et al., filed Nov. 27, 2019, which application is assigned to the current assignee hereof and incorporated herein by reference in its entirety.

TECHNICAL FIELD

The present invention relates, in general, to the field of drilling and processing of wells. More particularly, present embodiments relate to a system and method for adjustability of a height of a catwalk system used to deliver tubulars from a horizontal storage to a rig floor.

SUMMARY

In accordance with an aspect of the disclosure, a system for conducting subterranean operations that can include a pipe handling system with a base skid with a longitudinal recess, a lift arm, a carrier rotationally coupled to the lift arm, and the carrier configured to be disposed in the longitudinal recess of the base skid; and a ramp rotationally coupled to the base skid, with the ramp comprising a bottom section and a top section, with the bottom section comprising a first interfacing feature configured to mate with a second interfacing feature of the top section, wherein the first interfacing feature is complementarily shaped to mate with the second interfacing feature.

In accordance with another aspect of the disclosure, a method for conducting subterranean operations that can include operations of installing a pipe handling system proximate a first rig, and adjusting a length of a ramp of the pipe handling system to accommodate a height of a first rig floor of the first rig by installing one or more extension sections of the ramp between a bottom section of the ramp and a top section of the ramp, wherein installing the one or more extension sections comprises inserting a protruding interfacing feature into a recess interfacing feature, wherein the inserting the protruding interfacing feature aligns the one or more extension sections with either one of the bottom section or the top section.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Present embodiments provide an adjustable pipe-handling system (e.g. catwalk system) to support subterranean operations. The adjustable pipe-handling system can include an adjustable ramp, adjustable lift arm, and adjustable base skid. The adjustable pipe-handling system can support rigs with drill floor at different heights from the ground.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
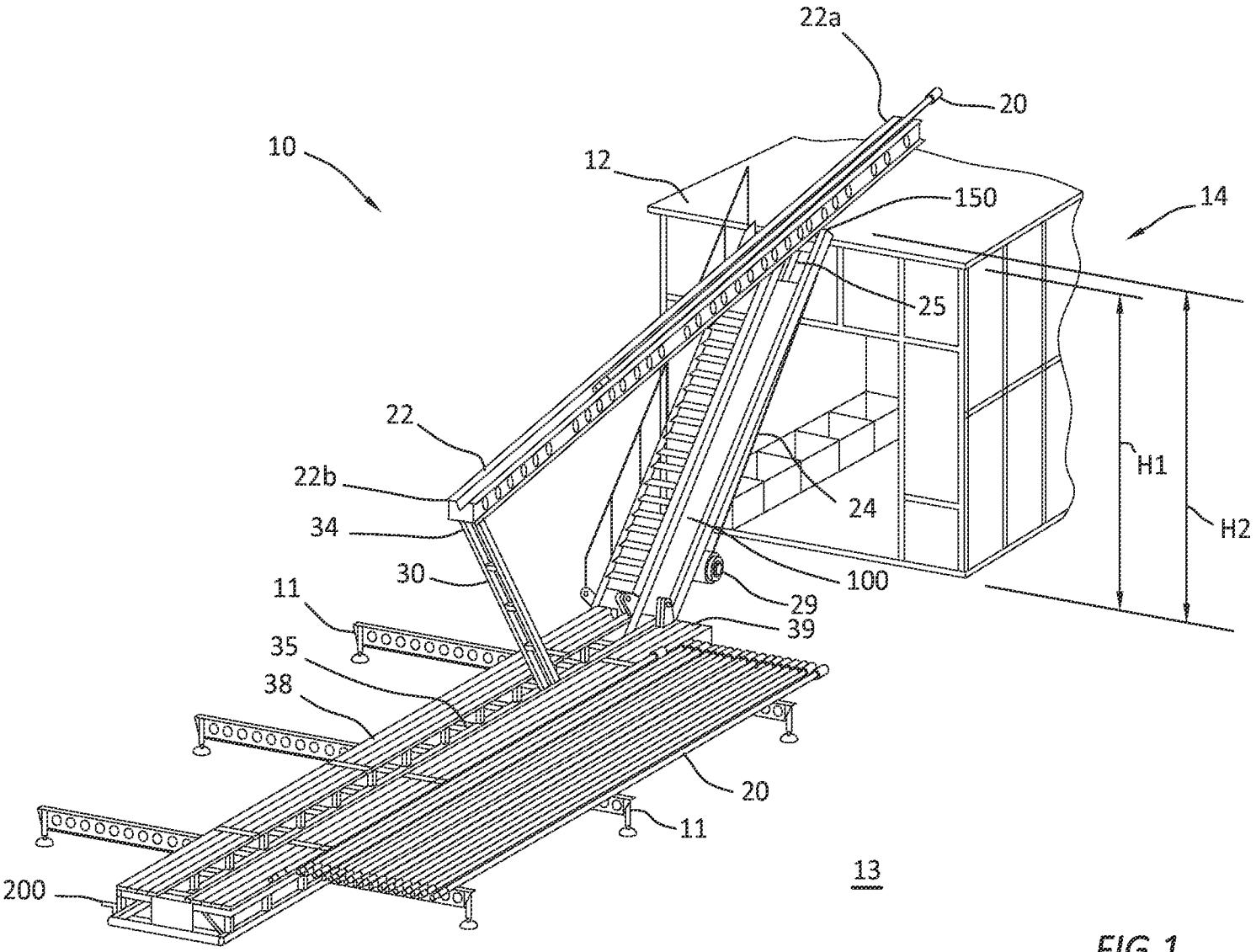
FIG. 1 is a representative perspective view of a pipe handling system installed adjacent a rig, in accordance with certain embodiments.

FIG. 1 shows a pipe-handling system 10 for conveying pipe from a ground-supported pipe rack 11 onto the drill floor 12 of a rig 14. The pipe-handling system 10 can include a ramp 100 and a base skid 200 that may include one or more catwalks 38, 39 and a movable pipe carrier 22. The base skid 200 may be mounted on a ground surface 13 and ramp 100 interconnects the base skid 200 of the apparatus 10 with floor 12 of the drilling rig. Pipe racks 11 can be positioned adjacent the base skid 200 to hold a supply, or receive, pipe joints 20. Pipe joints 20 can be passed between the drilling rig and the pipe racks by pipe carrier 22. As used herein, "pipe joints" refer to an elongated tubular with threaded ends, which can include a single tubular segment with threaded ends or a tubular stand that contains two or more tubular segments that are connected together by threaded joints. Other rig equipment can be passed up and down the ramp 100, such as a bottom hole assembly (BHA), rig floor equipment, and other tool assemblies.

Pipe-handling system 10 includes a drive system for moving the pipe carrier 22 between a lowered position to an elevated position, with the elevated position being shown in FIG. 1. In the following discussion, the term "ramp end" (indicated by 22*a*) is the end of the pipe carrier 22 adjacent the ramp 100, while the "far end" (indicated by 22*b*) of the pipe carrier 22 is the end opposite to the ramp end 22*a*. In the illustrated embodiment, the drive system may be based on a cable-drive including, for example, a winch 29 that may provide high-speed operation. Spaced-apart cables 24 can be roved about upper sheaves 25 and attached between the pipe carrier 22 and the winch 29.

The drive system can include a carrier elevation assembly that can include a lift arm 30 that is journaled at end 34 which is adjacent the far end of the pipe carrier 22. The pipe carrier 22 and lift arm 30 can ride along a track on the base skid 200 during elevating and lowering of the pipe carrier 22. The track can extend axially along the long axis of the base skid 200 and provides a support surface so that the assembly of the carrier 22 and the lift arm 30 can move along the track toward and away from the ramp 100.

The track may be positioned in a longitudinally extending, upwardly opening recess 35 for accommodating the pipe carrier 22 with an upper surface of the pipe carrier substantially flush with catwalks 38, 39 when the pipe carrier 22 is in the lowered position (i.e. disposed in the recess 35). Ramp 100 is formed to accept and support the ramp end 22*a* of carrier 22 as it moves thereover between its lowered and elevated positions relative to the rig floor 12. Ramp 100 further includes an upper end 150 including a bearing surface capable of supporting movement of the pipe carrier 22 thereover. The ramp end 22*a* of pipe carrier 22 can include opposed rollers that can ride in tracks of the ramp 100. An underside of the pipe carrier 22 can be formed to ride over the upper end 150 when the ramp end 22*a* exits the tracks, thus allowing further extension of the carrier 22 over the drill floor 12.

If the pipe-handling system 10 were to be moved to another rig 14, then a height H1 of the rig floor 12 relative to the ground 13 may be different at the new rig 14 location. To accommodate the new height H1, the pipe-handling system 10 can be adjusted to change its operating height H2, which indicates the height of the upper end 150 of the ramp 100 when deployed at the rig 14 location. The height H2 of the upper end 150 of the ramp 100 can be slightly higher than the height H1 of the rig floor 12 to allow the carrier 22 to be extended past the upper end 150 and over the rig floor 12. The following description provides a detailed description of the adjustability of the pipe-handling system 10 to accommodate rigs 14 with rig floors 12 at various heights H1.

Figure 2:
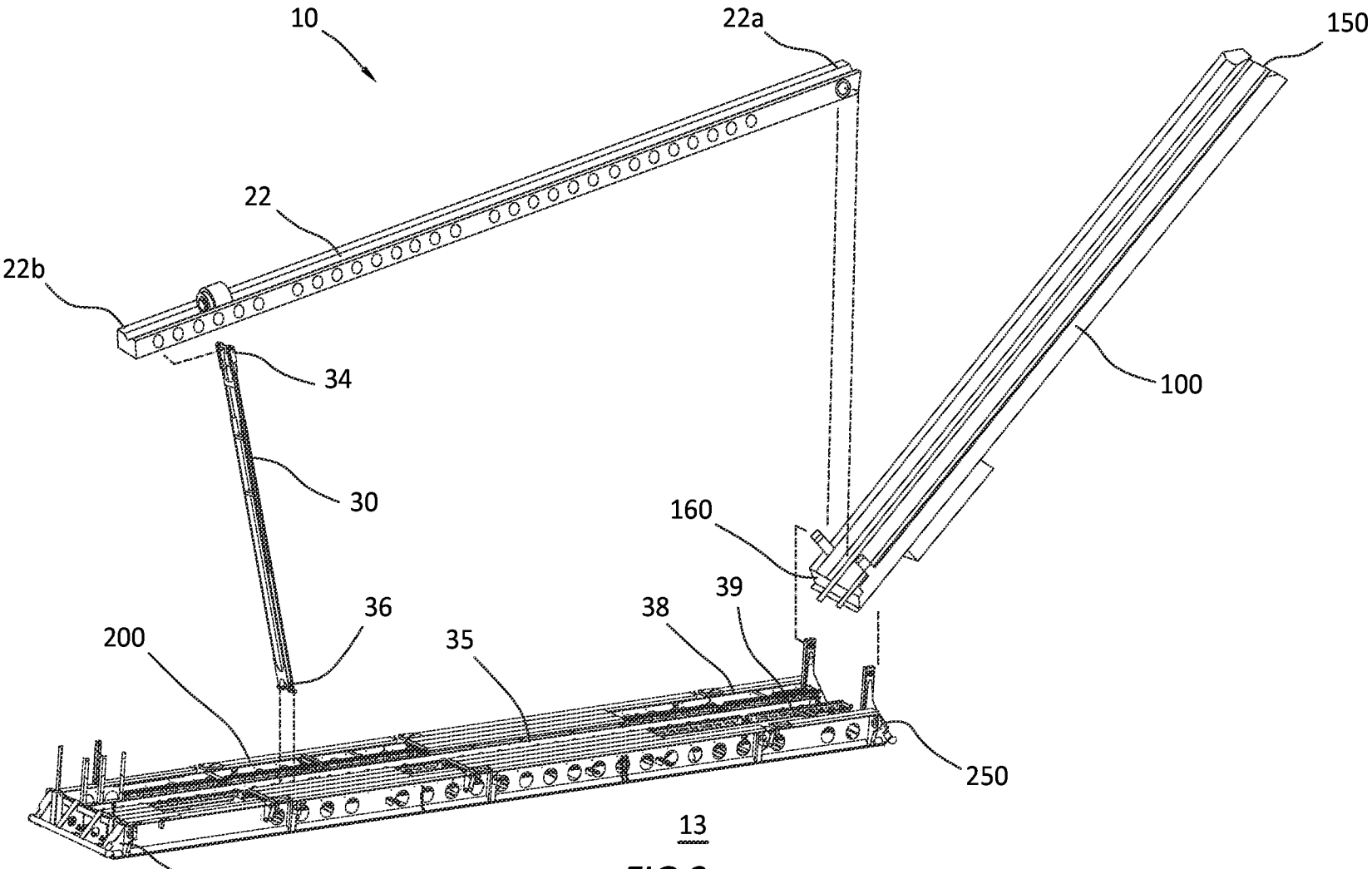
FIG. 2 is a representative exploded view of a pipe handling system, in accordance with certain embodiments.

FIG. 2 is a perspective view of a pipe-handling system 10. The base skid 200 can be positioned on a surface of the ground 13 and the base skid can include opposite ends 260, 250, with end 250 being closest to the rig 14 (see FIG. 1) and rotationally attached to the end 160 of the adjustable ramp 100. The end 150 of the adjustable ramp 100 can be positioned just above a rig floor 12 to facilitate delivery of tubulars from the pipe handling system 10 to the rig floor 12.

In operation, the carrier 22 can receive tubulars 20 from a horizontal storage location. In this position, the carrier 22 can be positioned in the recess 35 of the base skid 200 with the lift arm 30 folded up underneath the carrier 22 and also in the recess 35. As cables pull the ramp end 22*a* of the carrier 22 toward the rig floor 12, the ramp end 22*a* engages the adjustable ramp 100 at the end 160 and begins traveling up the adjustable ramp 100 as the cables continue to pull the carrier 22. The lift arm 30, which is rotationally mounted proximate the far end 22*b* at its end 34, slides along with the far end 22*b* until the lift arm end 36 engages a stop in the base skid. When the lift arm end 36 engages the stop, then the lift arm 30 can begin to rotate the lift arm end 34 out of the recess 35, thereby lifting the far end 22*b* out of the recess and lifting the carrier 22.

As the cables continue to pull the carrier 22 toward the end 150, the lift arm can continue to lift the far end 22*b*, while the cables pull the ramp end 22*a* along the ramp 100 toward the end 150. When the ramp end 22*a* reaches the end 150, the ramp end 22*a* can extend over the end 150 and further onto the rig floor 12. With different height rig floors, the length of the adjustable ramp 100, the angle of the adjustable ramp from the ground, the lift arm 30 stop position in the base skid 200, and the length of the lift arm contribute to the height H2 of the end 150 off the ground 13.

Figure 3:
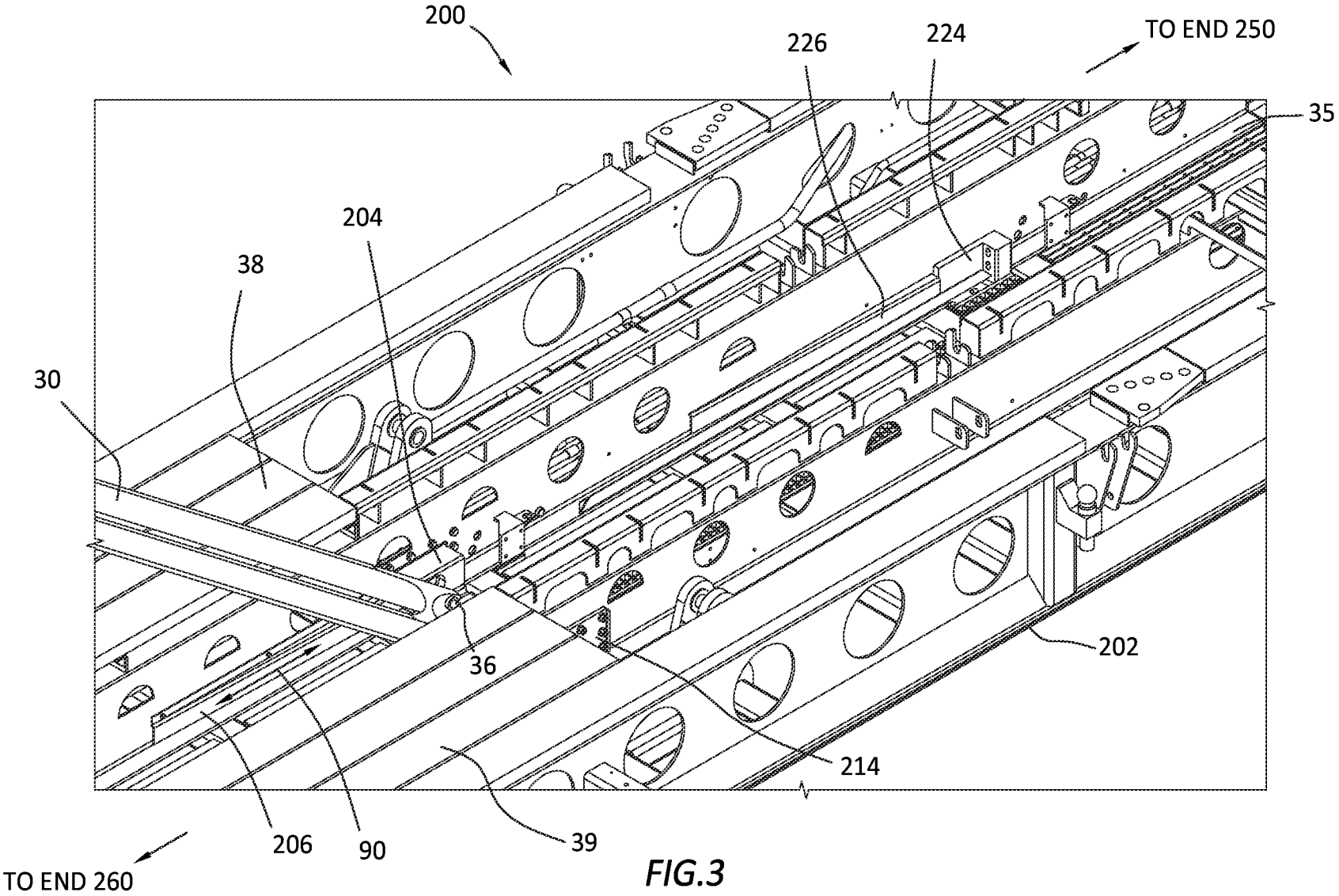
FIG. 3 is a representative perspective view of a configurable pivot connection of a lift arm to a base skid, in accordance with certain embodiments.

FIG. 3 is a representative perspective view of a configurable pivot connection of a lift arm to a base skid. This pivot connection can also be referred to as a stop position for the lift arm 30. As the lift arm end 36 slides through the recess 35 (see arrows 90), the lift arm 30 will begin to rotate out of the recess when the end 36 engages a stop (e.g. stop 204, 214, 224). In this configuration, a removable stop 204, 214 has been installed to capture the end 36 of the lift arm 30 and cause the lift arm 30 to rotate out of the recess 35, and lift the lift arm 34, with the far end 22*b*, out of the recess 35. If the stop 204, 214 were not installed in the recess 35, then the end 36 can continue further along the recess 35 to engage another stop 224. The stop 224 is shown here without a similar U-shaped pocket into which a roller at the end 36 engages the stop to support rotation of the lift arm 30 out of the recess 35. By positioning various other stop position along the recess 35 in the base skid 200, the lift arm can be configured to lift the far end 22*b* at different times and therefore adjust a final height of the far end 22*b*. Each stop 204, 224, can include a guide ramp 206, 226 to ensure smooth transition of the end 36 into engagement with a stop.

Figure 4A:
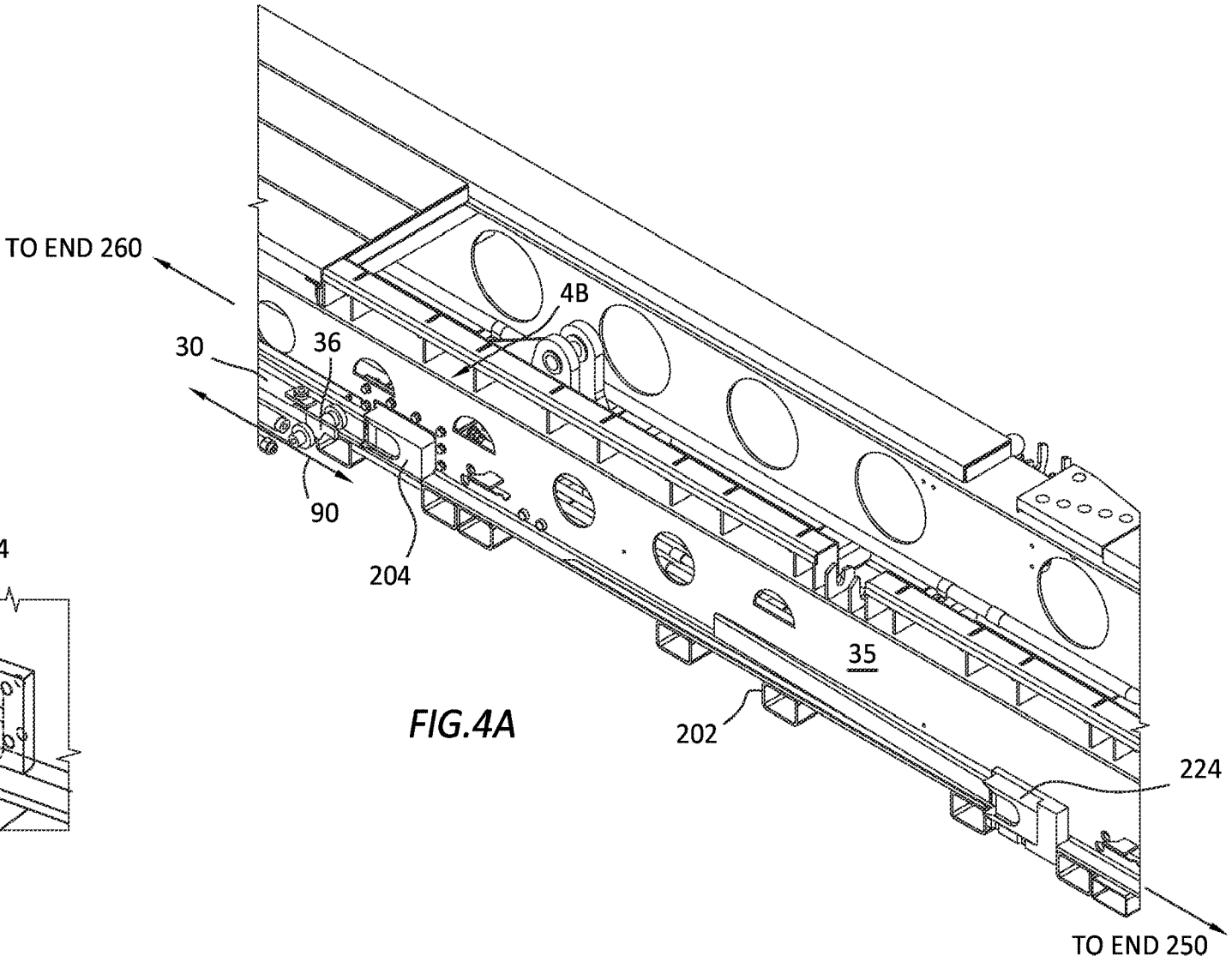
FIG. 4A is a representative partial cross-sectional view of a base plate that illustrates optional configurable pivot connection points for a lift arm, in accordance with certain embodiments.
Figure 4B:
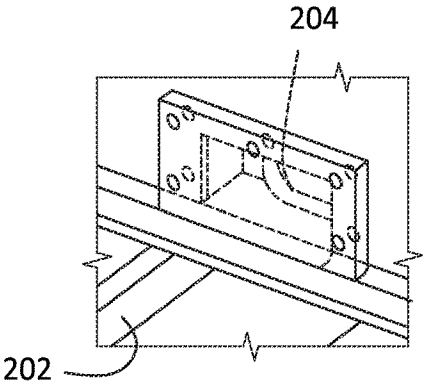
FIG. 4B is a representative perspective rear view of a configurable pivot connection position shown in FIG. 4A, in accordance with certain embodiments.

FIG. 4A is a representative partial cross-sectional view a base plate that illustrates optional configurable pivot connection points for a lift arm. The lift arm end 36 can travel along the recess 35 (arrows 90) until the end 36 engages a stop 204, 224. In this configuration, the stop 204 will prevent the end 36 from reaching the stop 224. However, the base skid 200 can be configured to have the end 36 engage the stop 224 by replacing the stop 204 with a feature that allows the end 36 to travel past the stop 204 position. FIG. 4B is a representative perspective rear view of the configurable pivot connection position (or stop 204) shown in FIG. 4A. This view indicates how the stop 204 can be installed. This shows a flange of the stop 204 that extends outside of the opening in the wall of the base skid 200 proximate the recess 35. Fasteners can be installed in the aligned holes in the stop 204 flange and the wall.

Figure 5:
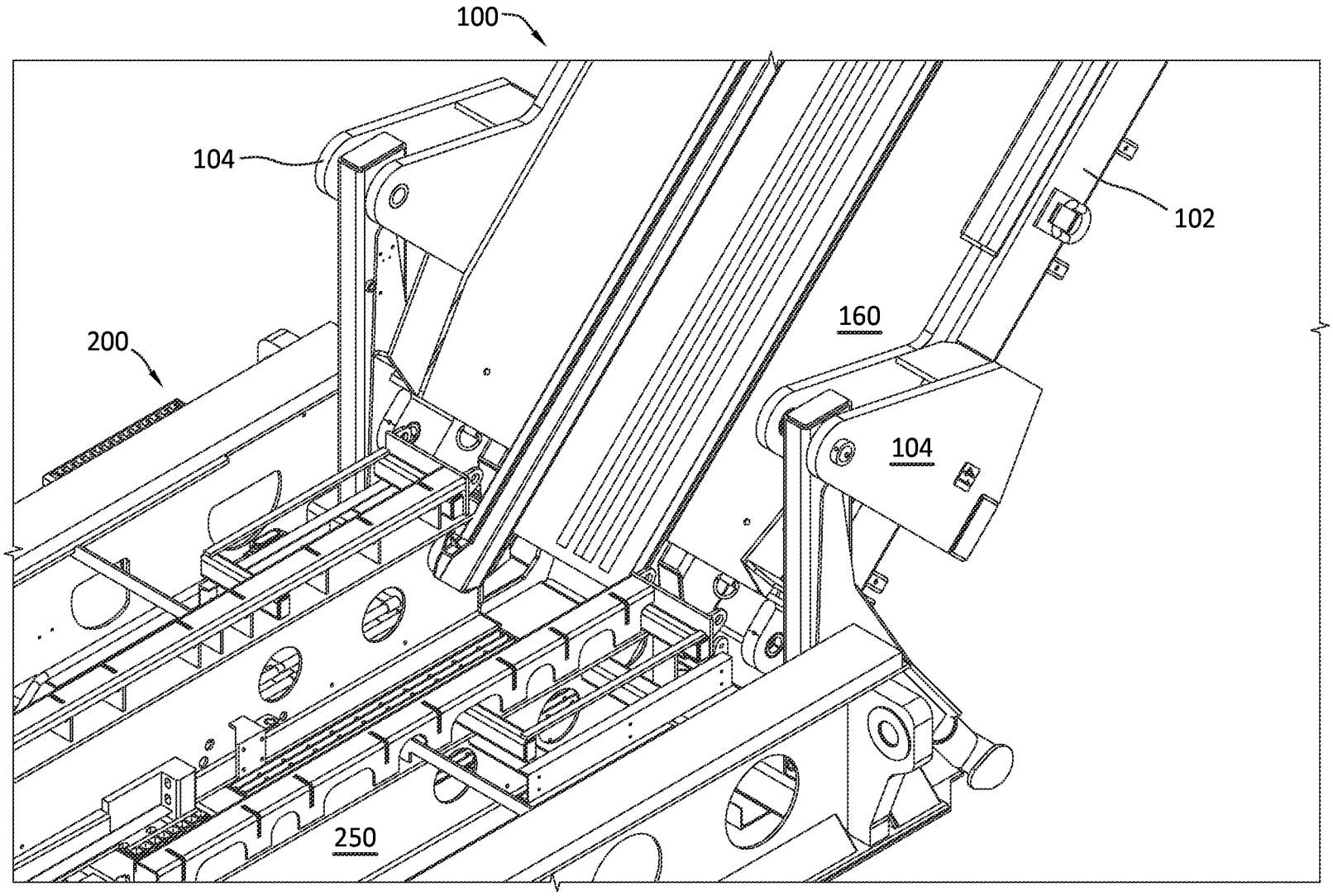
FIG. 5 is a representative perspective view of a ramp pivotably connected to a base skid, in accordance with certain embodiments.

FIG. 5 is a representative perspective view of the ramp 100 at end 160 pivotably connected to the base skid 200 at end 250.

Figure 6:
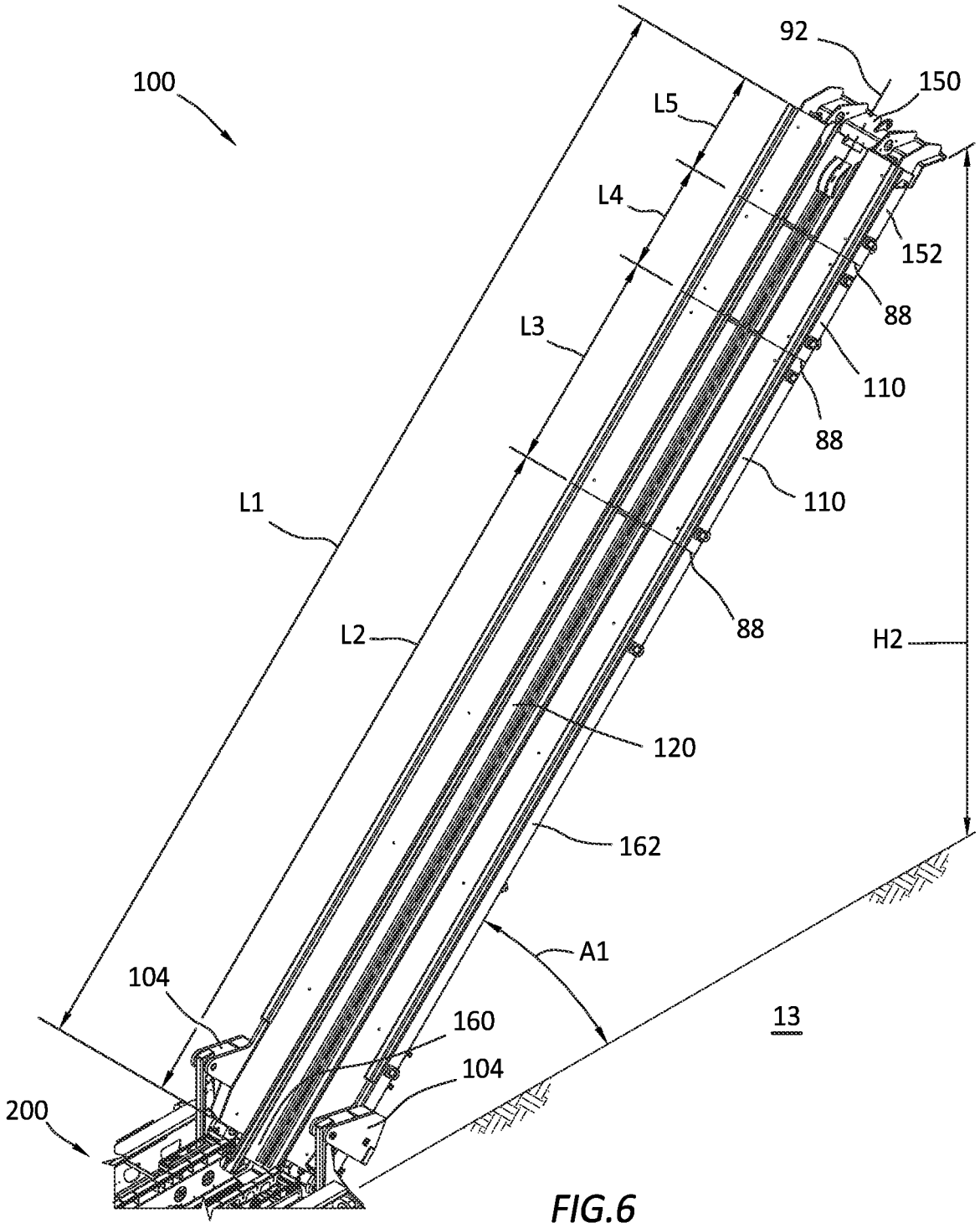
FIG. 6 is a representative perspective view of an adjustable ramp, including various extension sections, pivotably connected to a base skid, in accordance with certain embodiments.

FIG. 6 is a representative perspective view of an adjustable ramp 100, with various extension sections 110. The length L1 of the ramp 100 can be adjusted by adding or taking away one or more ramp extensions 110. The bottom section 162 can be rotationally connected to the base skid 200 at the end 160 via connection features 104. The bottom section 162 can have a length L2. The top section 152 can have a length L5. Therefore, length L1 can range from a minimum length, which is equal to L2 plus L5, to a maximum length L1, which can include the bottom section 162, the top section 152, and one or more extension sections 110, which can have various lengths (e.g. L3 or L4 in this example). Therefore, adjusting the angle A1 (i.e. the angle between the ground 13 and the ramp 100) and adjusting the number of extensions sections 110 included in the ramp 100 assembly, the pipe handling system 10 can adapt to various heights H2. The ramp 100 can include a longitudinal axis 92. Each connection of adjacent sections in the ramp 100 assembly can be referred to as an engagement interface 88, with each engagement surface 84 (see FIGS. 7 and 8) of one section engaging an engagement surface 86 of the adjacent section.

Figure 7:
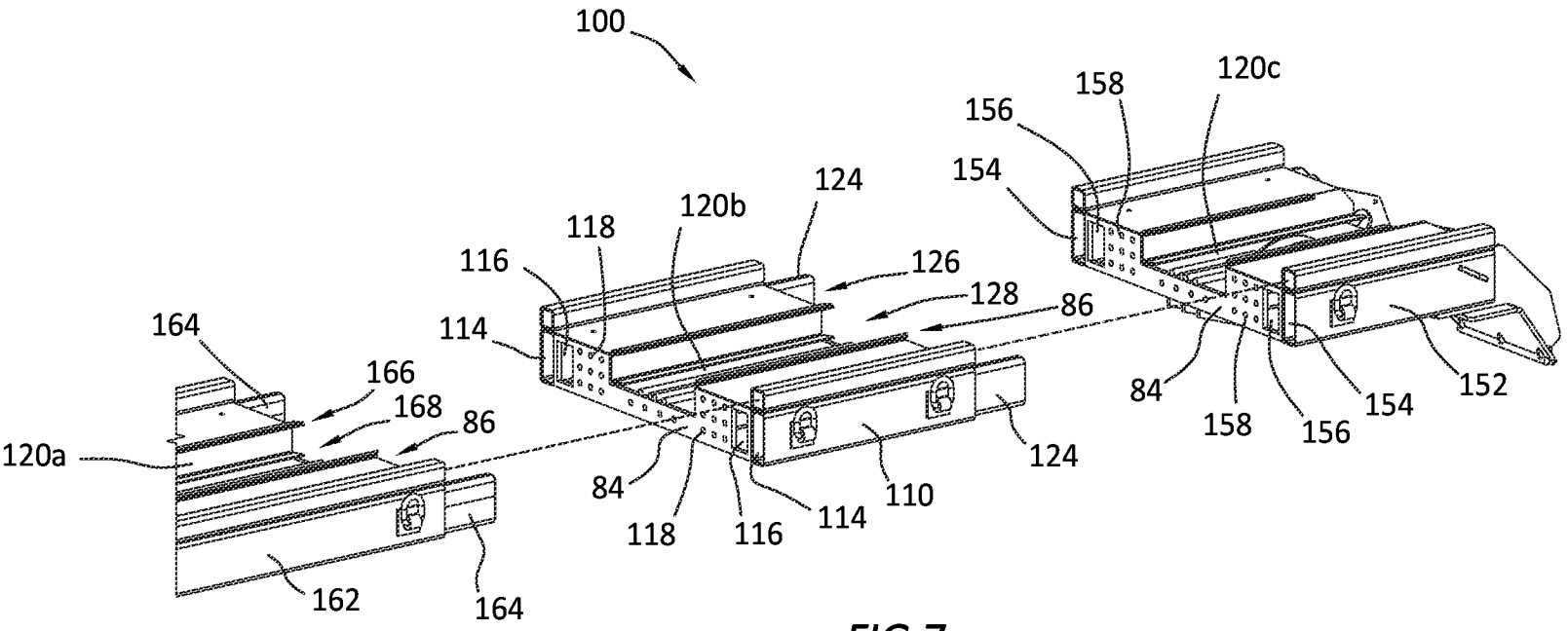
FIG. 7 is a representative exploded view of an adjustable ramp with an extension section disposed between top and bottom ramp sections, in accordance with certain embodiments.

FIG. 7 is a representative exploded view of an adjustable ramp with an extension section 110 disposed between the bottom and top ramp sections 162, 152. The male interfacing features 164 of the bottom section 162 can mate with the female interfacing features 154 of the extension section 110, while the male interfacing features 124 of the extension section 110 can mate with the female interfacing features 154 of the top section 152. It should be understood that the male or female interfacing features can be disposed on either of the extension section 110 or top and bottom sections 152, 162, so the interfacing features can mate with each other when the ramp 100 is assembled. In general, interfacing features 164 on the top end of the bottom section 162 can mate with the interfacing features 114 on the bottom of the first extension section 110, and interfacing features 154 on the top end of the extension section 110 can mate with the interfacing features 124 on the bottom of another extension section 110 or interfacing features 154 on the bottom of the top section 152. The engagement surface 86 engages the engagement surface 84 of an adjacent ramp section to form an engagement interface 88 when the adjacent sections are connected in the ramp assembly.

The bottom section 162 can have interfacing features 164 that protrude from the top end of the bottom section 162, with these features 164 complementarily shaped to mate with interface features 114 on an extension section 110 or with interface features 154 on the top section 152. The bottom section 162 can have interfacing features 166 that protrude from the end of the bottom section 162, with these features 166 complementarily shaped to mate with interface features 116 on an extension section 110 or with interface features 156 on the top section 152. The bottom section 162 can have holes 168, which can be aligned with holes 118 in the end of the extension section 110 or holes 158 in the end of the top section 152, through which fasteners can be installed to secure the bottom section 162 to the extension section 110 or secure the bottom section 162 to the top section 152. In an example with the extension section 110 installed in the ramp 100, then interfacing features 128, which can be holes, can be aligned with holes 158 in the end of the top section 152, through which fasteners 80 can be installed to secure the extension section 110 to the top section 152. When the sections 152, 110, 162 are assembled, they can form the ramp 100 assembly with a channel 120 that includes the channel sections 120*a*, 120*b*, 120*c*.

Figure 8B:
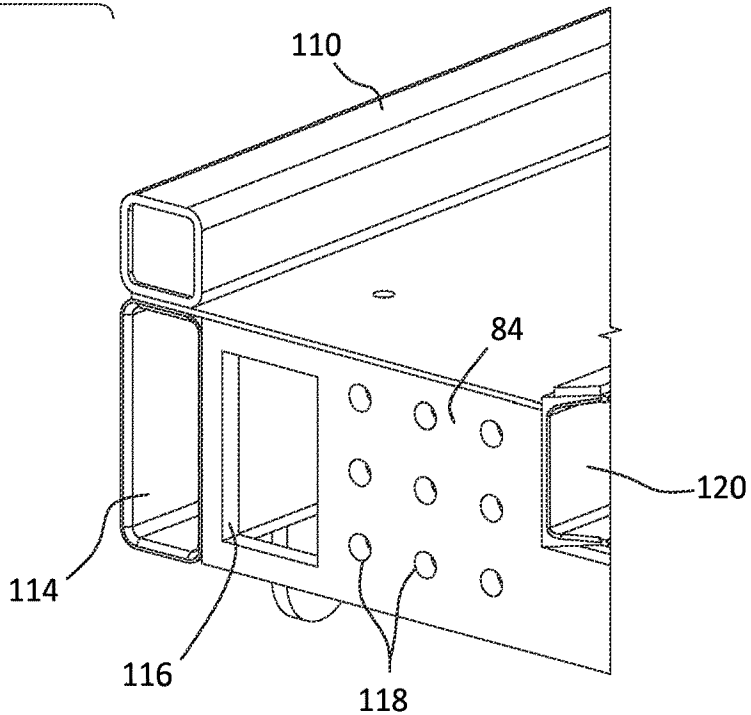
FIG. 8B is a representative perspective view of a bottom end of an adjustable ramp section with female interfacing features, in accordance with certain embodiments.
Figure 8A:
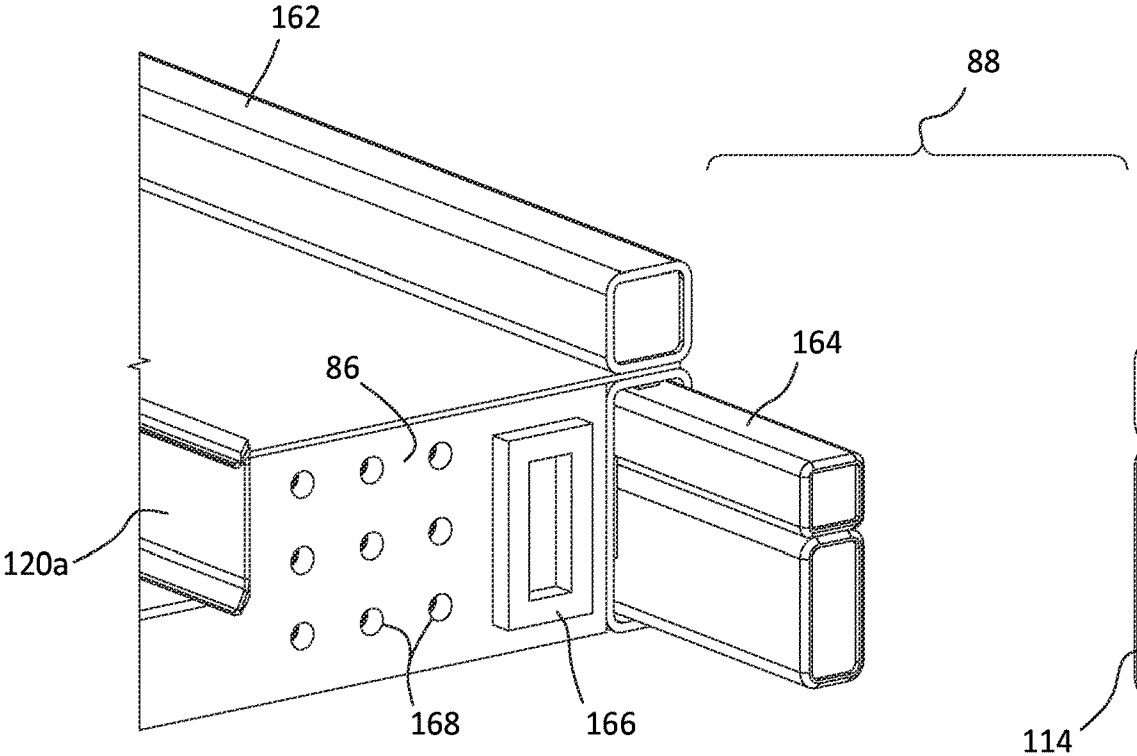
FIG. 8A is a representative perspective view of a top end of ramp sections with male interfacing features, in accordance with certain embodiments.

FIG. 8A is a representative perspective view of a top end of ramp sections 162 with male interfacing features. FIG. 8B is a representative perspective view of a bottom end of ramp sections 110 with female interfacing features. This description can similarly apply to the interface between the top section 152 and an interface section. It should be understood that any of the male and female interfacing features can be disposed on either of the sections. As can be seen from FIGS. 8A, 8B, in a particular example, the interfacing feature 164 of the bottom section 162 can be inserted into the interfacing feature 114 of the extension section 110. The interfacing feature 164 is shown with two portions that make up the feature 164. However, the feature 164 can be made from one portion protruding from the surface similar to feature 124 shown in FIG. 7. Therefore, it doesn't matter how many individual portions are used to produce the interfacing feature 164 or 124, as long as the resulting interfacing features properly interfaces with the complementarily shaped feature on an opposing face of the adjacent section.

An interfacing feature 166 can be used to further assist in alignment of the adjacent sections to each other to provide addition strength of the connection as well as alignment. In some examples, the interfacing feature 164 can provide a coarse alignment when first inserted into the interfacing feature 114 of the adjacent section, with a finer alignment achieved as the interfacing feature 164 is inserted further into the interfacing feature 114. As the adjacent sections 162, 110 are moved closer to engagement, then the interfacing feature 166 can be inserted into interfacing feature 116 to provide increased alignment accuracy. This alignment can be used to sufficiently align the interfacing feature 168 with the interfacing feature 118, where the interfacing feature 168 and 118 are holes, through which fasteners can be installed to capture and hold the sections 162, 110 together when the ramp is deployed to the rig site. In addition to alignment, interfacing features 164 coupled with interfacing features 114 and interfacing features 166 coupled with interfacing features 116 provide a secondary load transferring mechanism in the event that fasteners 80 through interfacing features 168 and interfacing features 118 become loose or insufficient. Also, interfacing features 164 coupled with interfacing features 114 and interfacing features 166 coupled with interfacing features 116 can retain the engagement while inserting fasteners 80 through interfacing features 168, 118.

Figure 9:
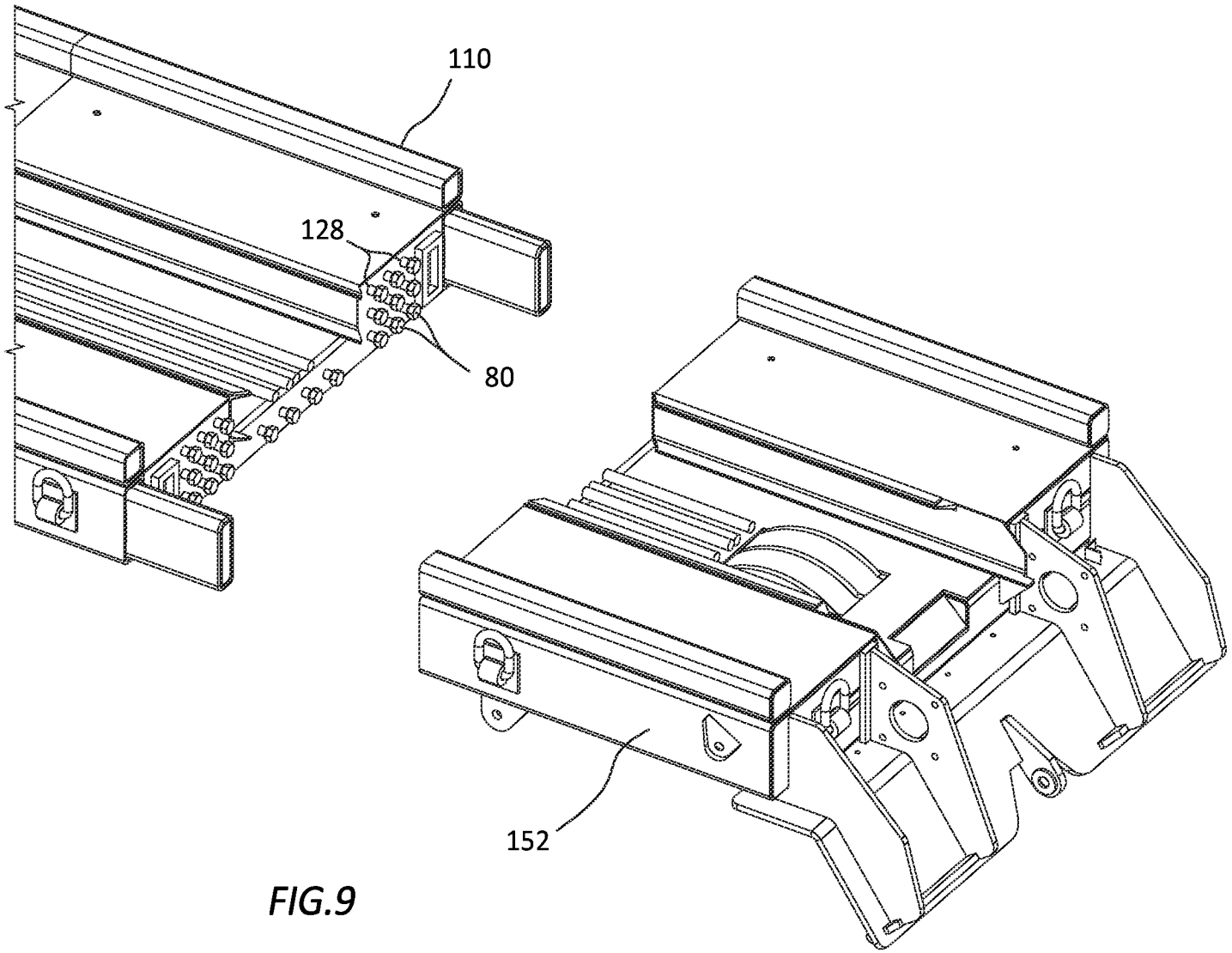
FIG. 9 is a representative exploded view of a top ramp section that can interface with an adjacent ramp section, in accordance with certain embodiments.

FIG. 9 is a representative exploded view of a top ramp section 152 that can interface with an adjacent extension ramp section 110. This view shows a plurality of fasteners 80 that can be used to attach the top section 152, such as being installed through the plurality of interfacing features 128 and 158, which can be holes 128, 158.

Figure 10A:
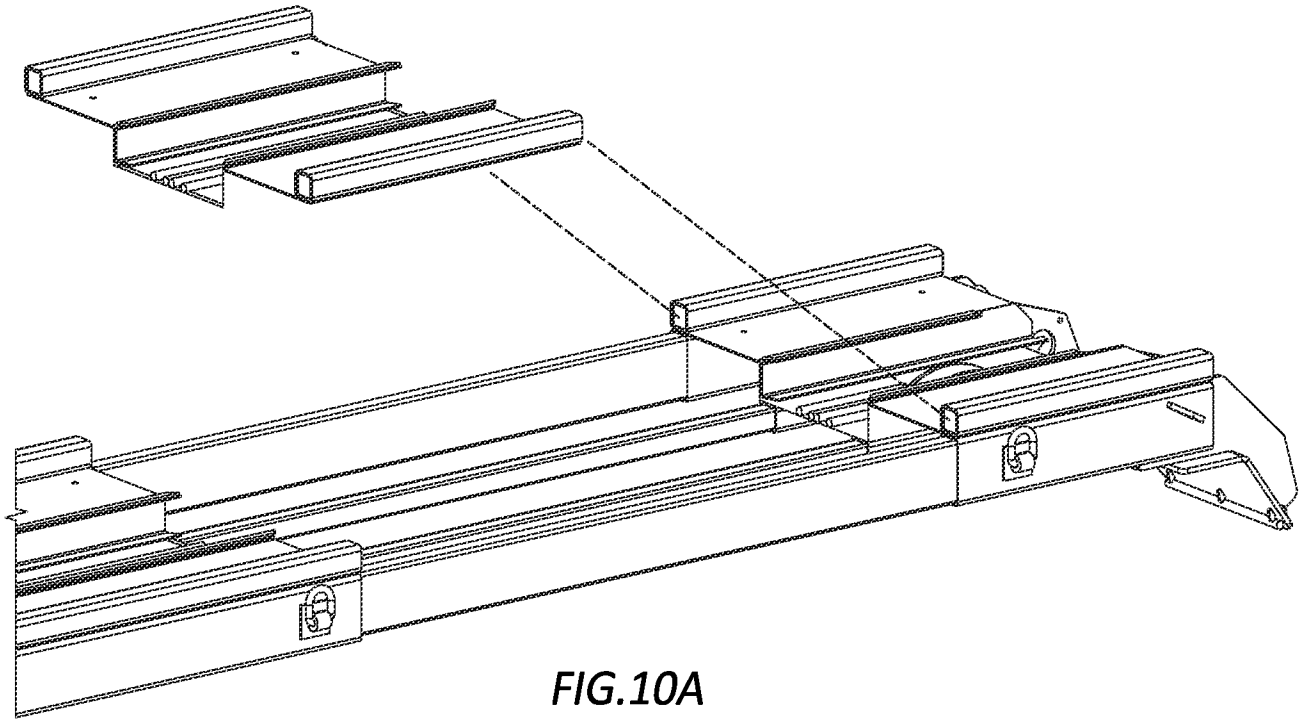
FIG. 10A is a representative perspective view of another adjustable ramp telescopically extendable with an extension section disposed above the telescoping section for clarity, in accordance with certain embodiments.
Figure 10B:
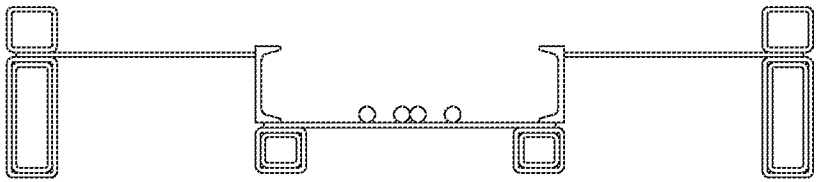
FIG. 10B is a representative partial cross-sectional view 10B-10B, as indicated in FIG. 10A, with the extension section installed, in accordance with certain embodiments.

FIG. 10A is a representative perspective view of another adjustable ramp 100 telescopically extendable with an extension section disposed above the telescoping section for clarity. When the ramp 100 is extended the appropriate amount, one or more extension sections 110 can be installed in the ramp 100. FIG. 10B is a representative partial cross-sectional view of the extended portion of the ramp 100 as shown in FIG. 10A, with the extension section installed.

Figure 11A:
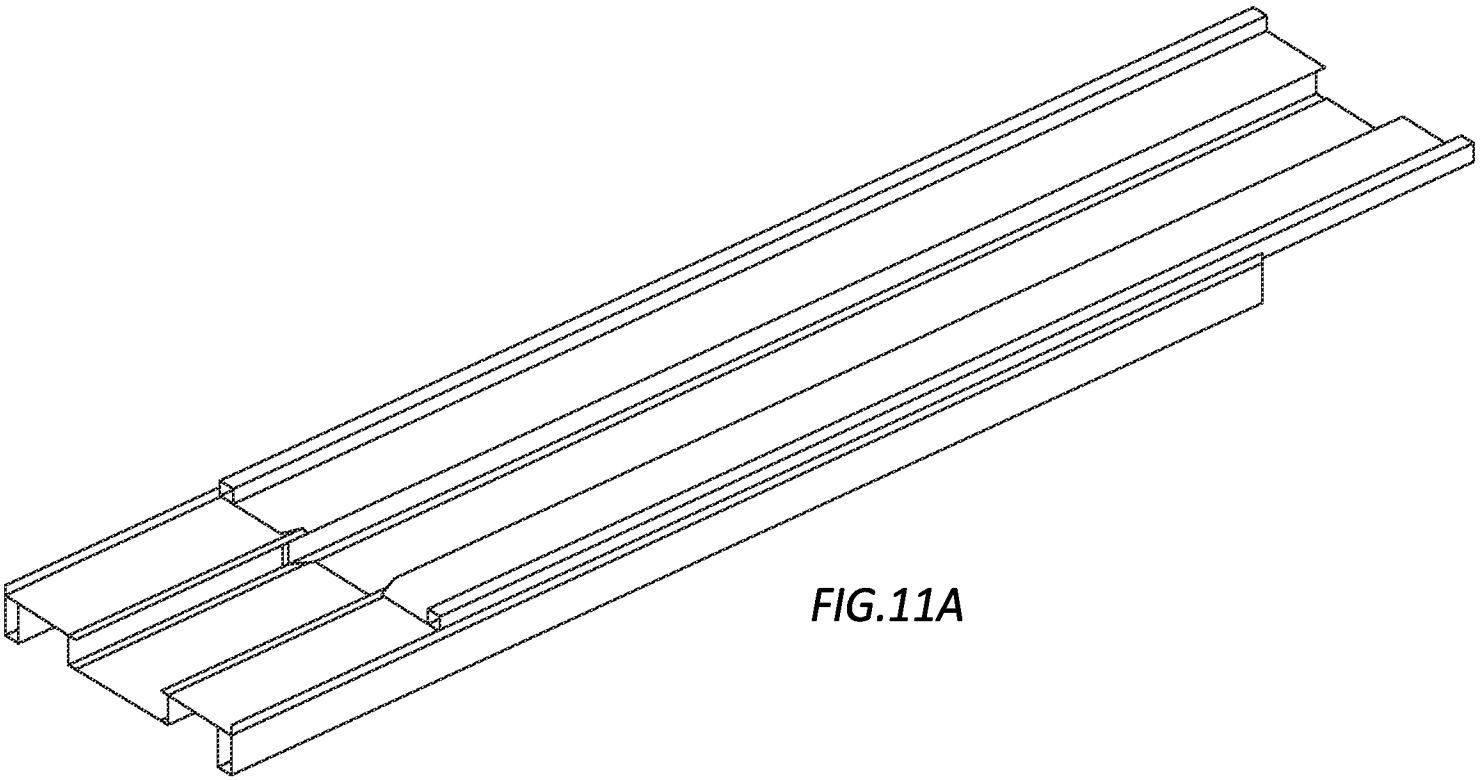
FIG. 11A is a representative perspective view of another adjustable ramp telescopically extendable, in accordance with certain embodiments.
Figure 11B:
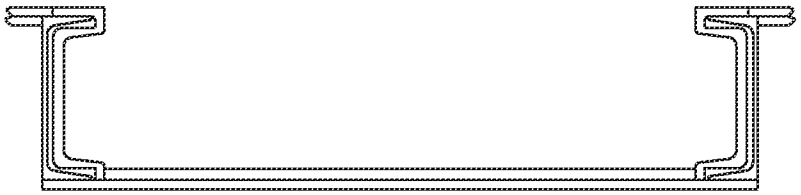
FIG. 11B is a representative partial cross-sectional view 11B-11B, as indicated in FIG. 11A, in accordance with certain embodiments.

FIG. 11A is a representative perspective view of another adjustable ramp that is telescopically extendable. The top ramp feature can slidingly interface with the other ramp feature, with the length L1 being adjusted when the ramp features are moved relative to each other and fixed at a final position through fasteners or other means. FIG. 11B is a representative partial cross-sectional view of the extendable ramp shown in FIG. 11A.

Figure 12A:
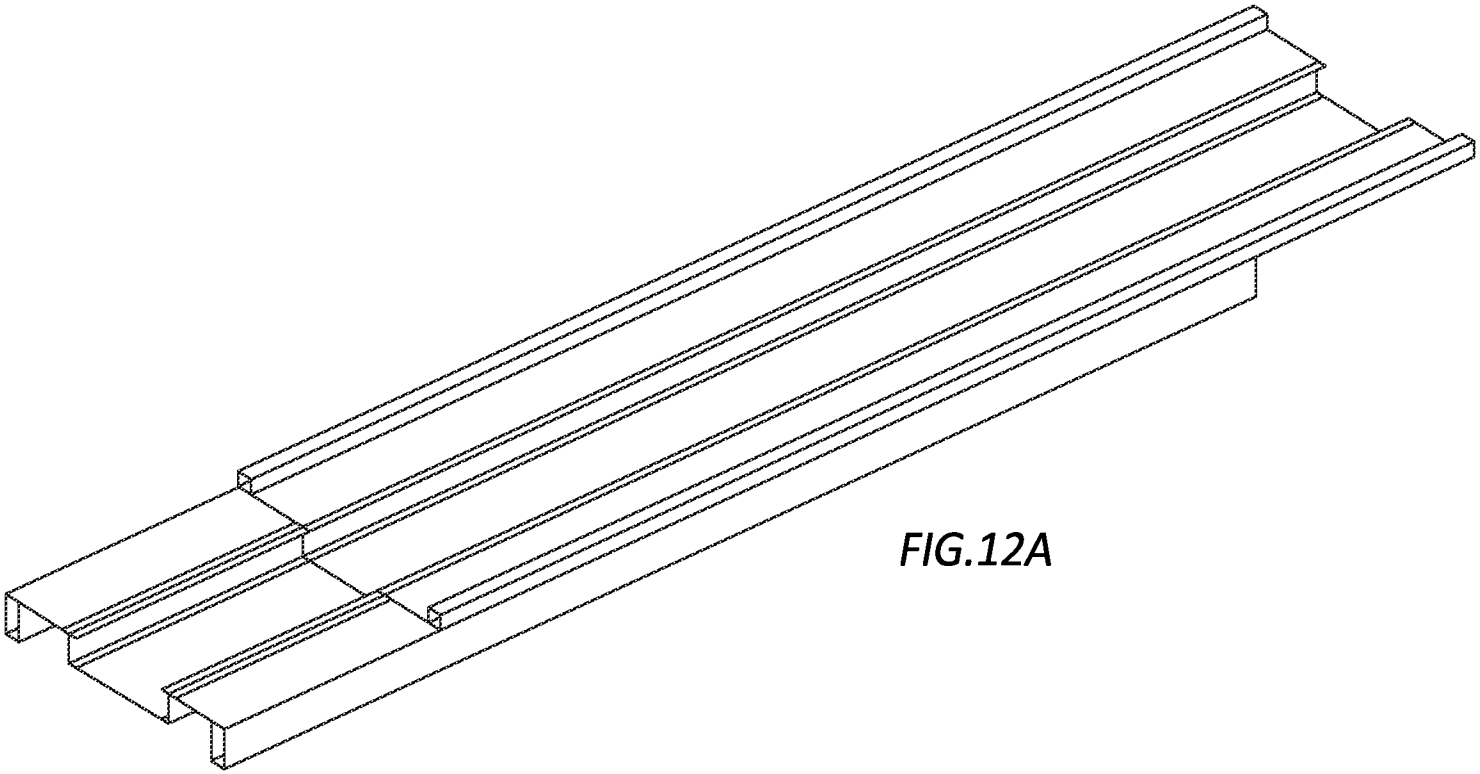
FIG. 12A is a representative perspective view of another adjustable ramp telescopically extendable, in accordance with certain embodiments.
Figure 12B:
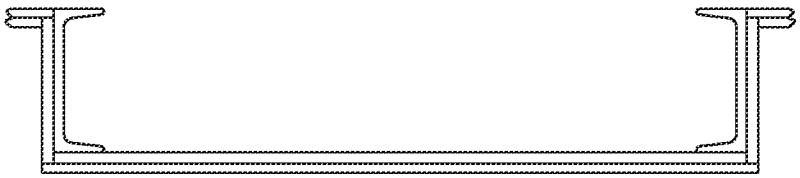
FIG. 12B is a representative partial cross-sectional view 12B-12B, as indicated in FIG. 12A, in accordance with certain embodiments.

FIG. 12A is a representative perspective view of another adjustable ramp is telescopically extendable. The top ramp feature can slidingly interface with the other ramp feature, with the length L1 being adjusted when the ramp features are moved relative to each other and fixed at a final position through fasteners or other means. Also, this embodiment provides smooth channel guide transitions to prevent any offset from the transition of one section to another section. FIG. 12B is a representative partial cross-sectional view of the extendable ramp shown in FIG. 12A.

Figure 13:
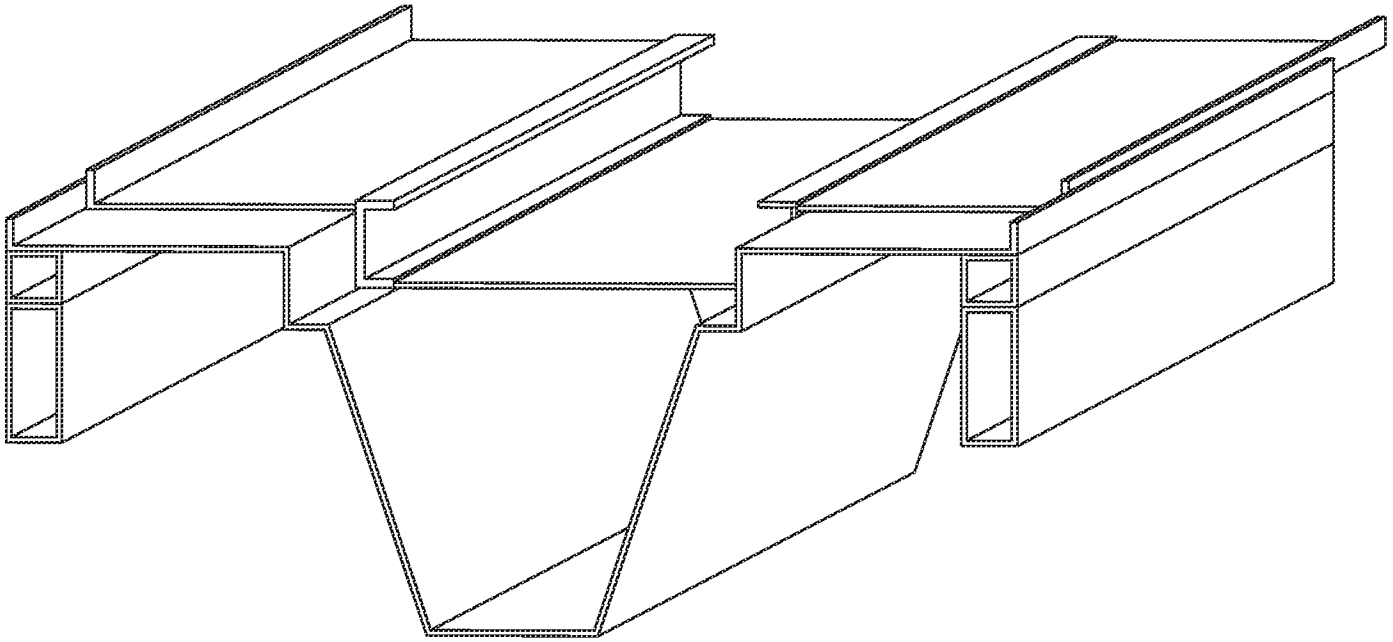
FIG. 13 is a representative perspective view of another adjustable ramp telescopically extendable, in accordance with certain embodiments.

FIG. 13 is a representative perspective view of another adjustable ramp is telescopically extendable. The top ramp feature can slidingly interface with the other ramp feature, with the length L1 being adjusted when the ramp features are moved relative to each other and fixed at a final position through fasteners or other means.

Figure 14A:
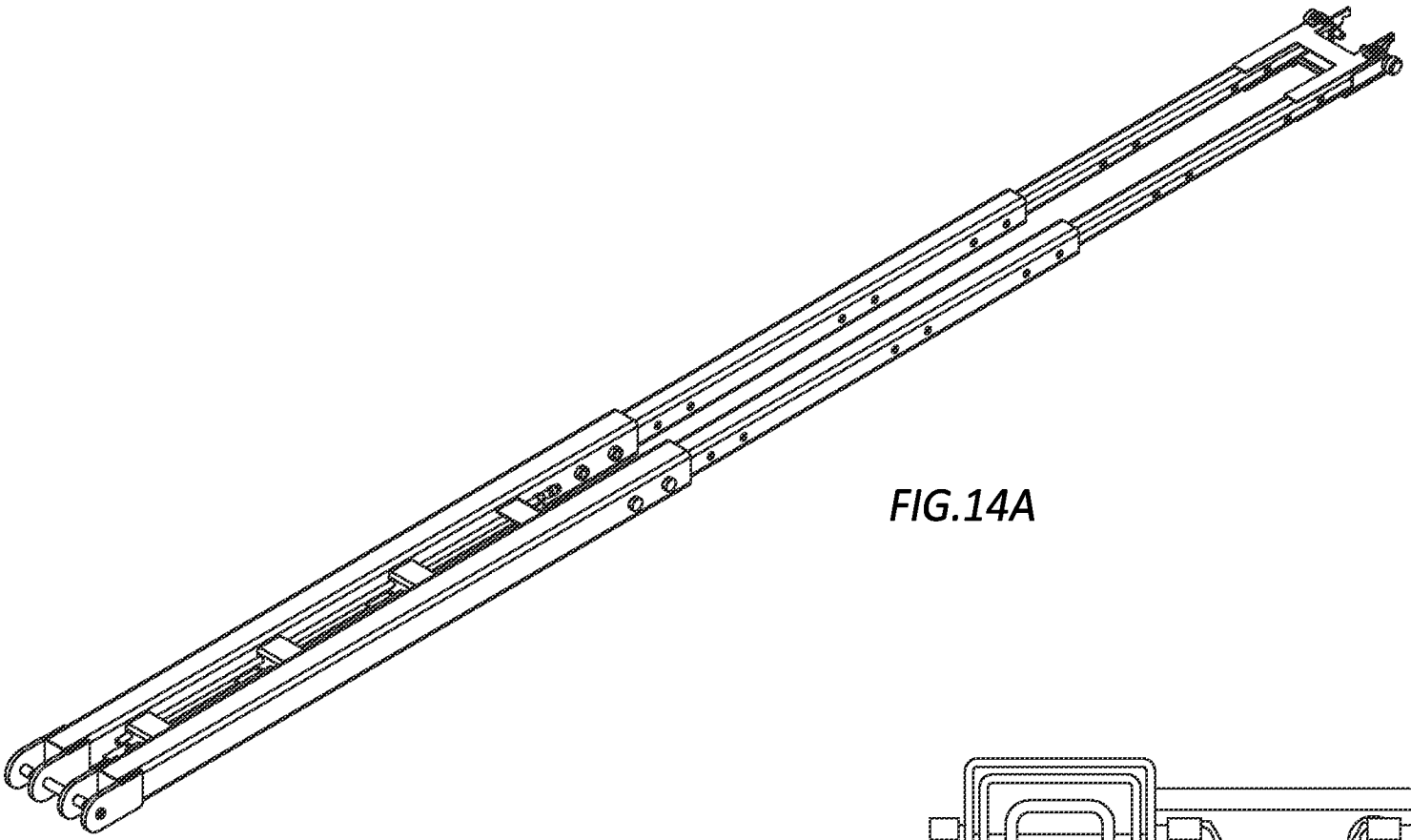
FIG. 14A is a representative perspective view of an adjustable lift arm that is telescopically extendable, in accordance with certain embodiments.
Figure 14B:
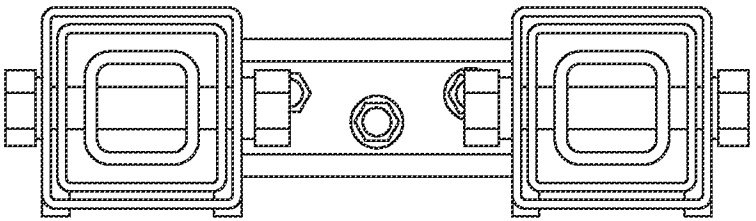
FIG. 14B is a representative partial cross-sectional view 14B-14B, as indicated in FIG. 14A, in accordance with certain embodiments.

FIG. 14A is a representative perspective view of an adjustable lift arm 30 that is telescopically extended. FIG. 14B is a representative partial cross-sectional view of the adjustable arm in FIG. 14A. Multiple similarly shaped tubulars can be nested together with one of one tubular received in a larger tubular, which is then received in an even larger tubular. As these nested tubulars are extended or retracted, the length lift arm can be adjusted, which can cooperate with the other elements of the pipe handling system 10 to adjust the operating height H2 of the pipe handling system 10.

Figure 15A:
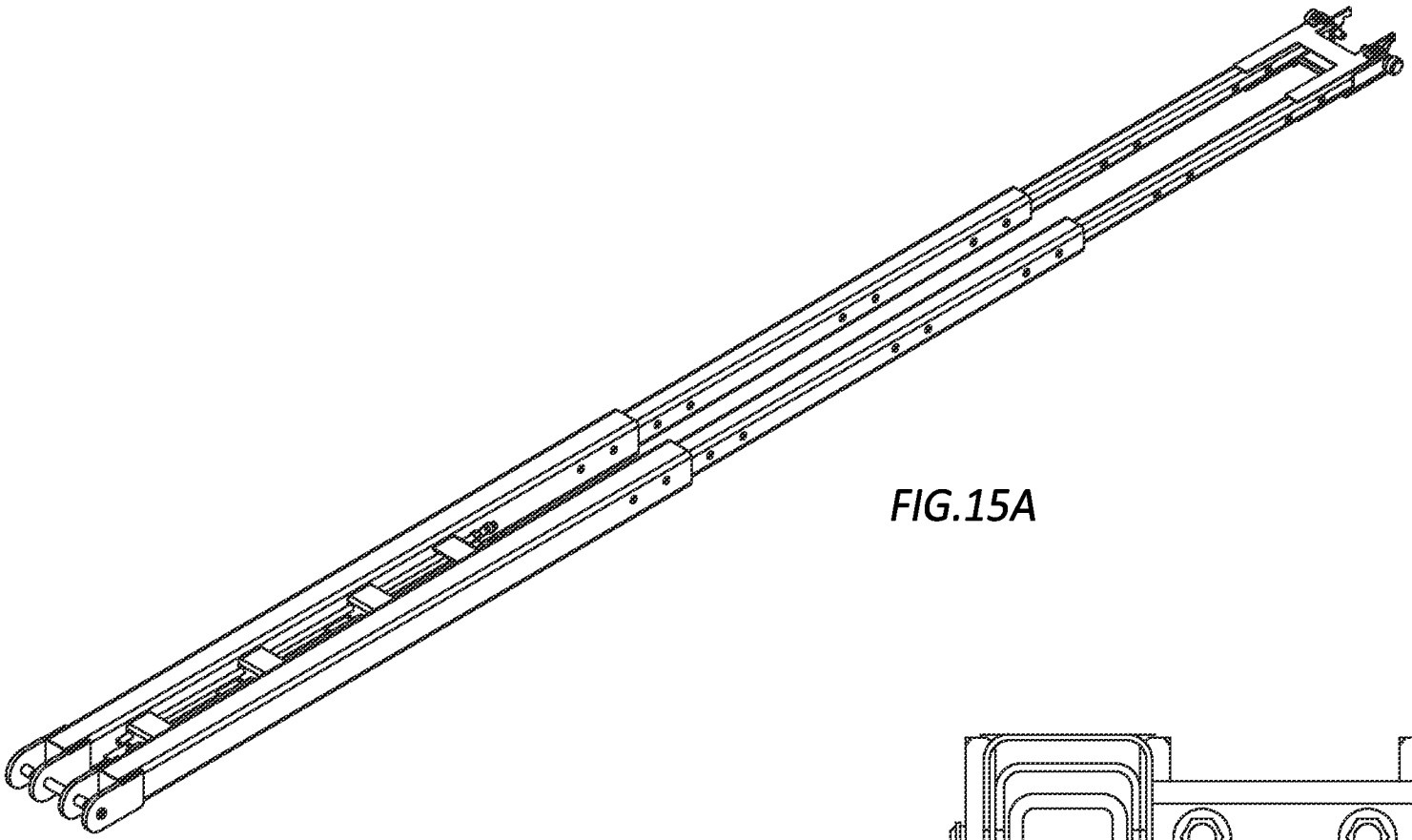
FIG. 15A is a representative perspective view of another adjustable lift arm that is telescopically extendable, in accordance with certain embodiments.
Figure 15B:
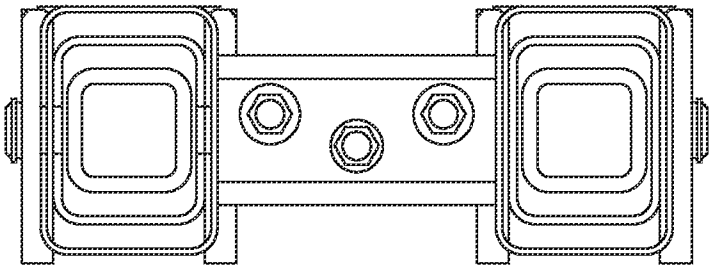
FIG. 15B is a representative partial cross-sectional view 15B-15B, as indicated in FIG. 15A, in accordance with certain embodiments.

FIG. 15A is a representative perspective view of an adjustable lift arm 30 that is telescopically extended. FIG. 15B is a representative partial cross-sectional view of the adjustable arm in FIG. 15A. Multiple similarly shaped tubulars can be nested together with one of one tubular received in a larger tubular, which is then received in an even larger tubular. As these nested tubulars are extended or retracted, the length lift arm can be adjusted, which can cooperate with the other elements of the pipe handling system 10 to adjust the operating height H2 of the pipe handling system 10.

VARIOUS EMBODIMENTS

Embodiment 1. A system for conducting subterranean operations comprising:

a pipe handling system that comprises:

a base skid with a longitudinal recess;

a lift arm;

a carrier rotationally coupled to the lift arm, and the carrier configured to be disposed in the longitudinal recess of the base skid; and a ramp rotationally coupled to the base skid, with the ramp comprising a bottom section and a top section, with the bottom section comprising a first interfacing feature configured to mate with a second interfacing feature of the top section, wherein the first interfacing feature is complementarily shaped to mate with the second interfacing feature.

Embodiment 2. The system of embodiment 1, wherein the first interfacing feature is a protrusion extending from a first engagement surface and the second interfacing feature is a recess in a second engagement surface, or the first interfacing feature is a recess in the first engagement surface and the second interfacing feature is a protrusion extending from the second engagement surface.

Embodiment 3. The system of embodiment 2, wherein the protrusion extending from the first engagement surface has a rectangular cross-section.

Embodiment 4. The system of embodiment 1, wherein the bottom section further comprises a third interfacing feature configured to mate with a fourth interfacing feature of the top section.

Embodiment 5. The system of embodiment 1, wherein the ramp further comprises an extension section disposed between the bottom section and the top section with the extension section being in a same plane as the bottom section and the top section when the ramp is assembled, and a longitudinal channel that extends through the bottom section, the extension section, and the top section.

Embodiment 6. The system of embodiment 5, wherein the first interfacing feature is configured to mate with a third interfacing feature of the extension section and the second interfacing feature is configured to mate with a fourth interfacing feature on the extension section, wherein the first interfacing feature is complementarily shaped to mate with the third interfacing feature and the second interfacing feature is complementarily shaped to mate with the fourth interfacing feature.

Embodiment 7. The system of embodiment 1, wherein the first interfacing feature aligns the bottom section with the top section when the first interfacing feature mates with second interfacing feature.

Embodiment 8. A method for conducting subterranean operations comprising:

installing a pipe handling system proximate a first rig; and adjusting a length of a ramp of the pipe handling system to accommodate a height of a first rig floor of the first rig by installing one or more extension sections of the ramp between a bottom section of the ramp and a top section of the ramp, wherein installing the one or more extension sections comprises inserting a protruding interfacing feature into a recess interfacing feature, wherein the inserting the protruding interfacing feature aligns the one or more extension sections with either one of the bottom section or the top section.

Embodiment 9. The method of embodiment 8, wherein the ramp guides an end of a pipe carrier to or from the first rig floor, and wherein the pipe carrier is configured to transfer a pipe between a horizontal storage location and the first rig floor.

Embodiment 10. The system of embodiment 8, further comprising:

moving the pipe handling system from the first rig to proximate a second rig; and adjusting a length of a ramp of the pipe handling system to accommodate a height of a second rig floor of the second rig by installing or removing one or more extension sections of the ramp between a bottom section of the ramp and a top section of the ramp, wherein a height from the ground to the second rig floor is different than a height from the ground to the first rig floor.

Embodiment 11. A system for conducting subterranean operations comprising:

a pipe handling system that comprises:

a base skid with a longitudinal recess;

a lift arm;

a carrier rotationally coupled to the lift arm, and the carrier configured to be disposed in the longitudinal recess of the base skid; and a ramp rotationally coupled to the base skid, with the ramp comprising a bottom section and a top section, with the bottom section comprising a first interfacing feature configured to mate with a second interfacing feature of the top section, wherein the first interfacing feature is complementarily shaped to mate with the second interfacing feature.

Embodiment 12. The system of embodiment 11, wherein the first interfacing feature aligns the bottom section with the top section when the first interfacing feature mates with the second interfacing feature.

Embodiment 13. The system of embodiment 11, wherein the second interfacing feature comprises at least one protrusion fixedly attached to and extending from a second engagement surface, and wherein the first interfacing feature comprises at least one recess in a first engagement surface that is configured to receive the at least one protrusion.

Embodiment 14. The system of embodiment 11, wherein the first interfacing feature comprises at least one protrusion fixedly attached to and extending from a first engagement surface, and wherein the second interfacing feature comprises at least one recess in a second engagement surface that is configured to receive the at least one protrusion.

Embodiment 15. The system of embodiment 14, wherein the at least one protrusion has a rectangular cross-section.

Embodiment 16. The system of embodiment 14, wherein the at least one protrusion comprises a first protrusion and a second protrusion with both extending from the first engagement surface, and wherein the first protrusion and the second protrusion each have a rectangular cross-section.

Embodiment 17. The system of embodiment 16, wherein the first protrusion and the second protrusion each extends through the second engagement surface.

Embodiment 18. The system of embodiment 16, wherein the first protrusion and the second protrusion are positioned at opposite sides of the first engagement surface.

Embodiment 19. The system of embodiment 14, wherein the at least one protrusion extends through the second engagement surface.

Embodiment 20. The system of embodiment 11, wherein the ramp further comprises an extension section disposed between the bottom section and the top section with the extension section being in a same plane as the bottom section and the top section when the ramp is assembled.

Embodiment 21. The system of embodiment 20, wherein the ramp further comprises a longitudinal channel that extends through the bottom section, the extension section, and the top section.

Embodiment 22. The system of embodiment 20, wherein the first interfacing feature is configured to mate with a third interfacing feature of the extension section and the second interfacing feature is configured to mate with a fourth interfacing feature on the extension section, with the third interfacing feature being positioned at an opposite end of the extension section from the fourth interfacing feature.

Embodiment 23. The system of embodiment 22, wherein the first interfacing feature is complementarily shaped to mate with the third interfacing feature and the fourth interfacing feature is complementarily shaped to mate with the second interfacing feature.

Embodiment 24. The system of embodiment 23, wherein the first interfacing feature aligns the bottom section with the extension section when the first interfacing feature mates with the third interfacing feature, and wherein the fourth interfacing feature aligns the extension section with the top section when the fourth interfacing feature mates with the second interfacing feature.

Embodiment 25. The system of embodiment 22, wherein the first interfacing feature comprises a first protrusion fixedly attached to and extending from a first engagement surface, and wherein the third interfacing feature comprises a first recess in a third engagement surface that is configured to receive the first protrusion.

Embodiment 26. The system of embodiment 25, wherein the fourth interfacing feature comprises a second protrusion fixedly attached to and extending from a fourth engagement surface, and wherein the second interfacing feature comprises a second recess in a second engagement surface that is configured to receive the second protrusion.

Embodiment 27. The system of embodiment 26, wherein the first protrusion extending from the first engagement surface has a rectangular cross-section, wherein the second protrusion extending from the fourth engagement surface has a rectangular cross-section, and wherein the first protrusion extends through the third engagement surface, and the second protrusion extends through the second engagement surface.

Embodiment 28. A method for conducting subterranean operations comprising:

installing a pipe handling system proximate a first rig; and adjusting a length of a ramp of the pipe handling system to accommodate a height of a first rig floor of the first rig by installing one or more extension sections of the ramp between a bottom section of the ramp and a top section of the ramp, wherein installing the one or more extension sections comprises inserting a protruding interfacing feature into a recess interfacing feature, wherein the inserting the protruding interfacing feature aligns the one or more extension sections with either one of the bottom section or the top section.

Embodiment 29. The method of embodiment 28, wherein the ramp guides an end of a pipe carrier to or from the first rig floor, and wherein the pipe carrier is configured to transfer a pipe between a horizontal storage location and the first rig floor.

Embodiment 30. The method of embodiment 28, further comprising:

moving the pipe handling system from the first rig to proximate a second rig; and adjusting a length of a ramp of the pipe handling system to accommodate a height of a second rig floor of the second rig by installing or removing one or more extension sections of the ramp between a bottom section of the ramp and a top section of the ramp, wherein a height from the ground to the second rig floor is different than a height from the ground to the first rig floor.

Embodiment 31. The method of embodiment 28, further comprising:

moving the pipe handling system from the first rig to proximate a second rig; and adjusting one of:

a length of a ramp of the pipe handling system, a stop position along a recess in a base for a lift arm of the pipe handling system, an incline angle of the ramp relative to the ground, or combinations thereof;

to accommodate a height of a second rig floor of the second rig wherein a height from the ground to the second rig floor is different than a height from the ground to the first rig floor.

Embodiment 32. The method of embodiment 31, wherein adjusting the length of the ramp comprises installing or removing one or more extension sections of the ramp between a bottom section of the ramp and a top section of the ramp.

Embodiment 33. The method of embodiment 31, wherein adjusting the stop position comprises allowing the lift arm to slide along the recess in the base to a different position by moving or removing one or more stops in the base.

Embodiment 34. The method of embodiment 31, wherein adjusting the incline angle of the ramp comprises raising or lowering an upper end of the ramp that is proximate the second rig floor.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A system for conducting subterranean operations comprising:

a pipe handling system that comprises:

a base skid with a longitudinal recess;

a lift arm;

a carrier rotationally coupled to the lift arm, and the carrier configured to be disposed in the longitudinal recess of the base skid; and a ramp rotationally coupled to the base skid, the ramp comprising a bottom section and a top section, the bottom section comprising a first interfacing feature extending from a first engagement surface and configured to mate with a second interfacing feature of the top section and a third interfacing feature different from the first interfacing feature, extending from the first engagement surface a shorter distance from the first engagement surface than the first interfacing feature, and configured to mate with a fourth interfacing feature of the top section, wherein the first interfacing feature is complementarily shaped to the second interfacing feature, and wherein the third interfacing feature is complementarily shaped to the fourth interfacing feature.

2. The system of claim 1, wherein the first interfacing feature aligns the bottom section with the top section when the first interfacing feature mates with the second interfacing feature, and wherein the third interfacing feature aligns the bottom section with the top section when the third interfacing feature mates with the fourth interfacing feature.

3. The system of claim 1, wherein the first interfacing feature comprises at least one protrusion fixedly attached to and extending from the first engagement surface, and wherein the second interfacing feature comprises at least one recess in a second engagement surface that is configured to receive the at least one protrusion.

4. The system of claim 3, wherein the at least one protrusion has a rectangular cross-section.

5. The system of claim 3, wherein the at least one protrusion comprises a first protrusion and a second protrusion with both extending from the first engagement surface, and wherein the first protrusion and the second protrusion each have a rectangular cross-section.

6. The system of claim 5, wherein the first protrusion and the second protrusion each extends through the second engagement surface.

7. The system of claim 5, wherein the first protrusion and the second protrusion are positioned at opposite sides of the first engagement surface.

8. The system of claim 3, wherein the at least one protrusion extends through the second engagement surface.

9. The system of claim 1, wherein the ramp further comprises an extension section disposed between the bottom section and the top section with the extension section being in a same plane as the bottom section and the top section when the ramp is assembled.

10. The system of claim 9, wherein the ramp further comprises a longitudinal channel that extends through the bottom section, the extension section, and the top section.

11. The system of claim 9, wherein the first interfacing feature of the bottom section is configured to mate with a fifth interfacing feature of the extension section, and wherein the second interfacing feature of the top section is configured to mate with a sixth interfacing feature of the extension section, the fifth interfacing feature being positioned at an opposite end of the extension section from the sixth interfacing feature.

12. The system of claim 11, wherein the third interfacing feature of the bottom section is configured to mate with a seventh interfacing feature of the extension section, and wherein an eighth interfacing feature of the extension section is configured to mate with the fourth interfacing feature of the top section.

13. The system of claim 12, wherein the first interfacing feature of the bottom section aligns the bottom section with the extension section when the first interfacing feature of the bottom section mates with the fifth interfacing feature of the extension section, and wherein the sixth interfacing feature of the extension section aligns the extension section with the top section when the sixth interfacing feature of the extension section mates with the second interfacing feature of the top section.

14. The system of claim 11, wherein the first interfacing feature of the bottom section comprises a first protrusion fixedly attached to and extending from the first engagement surface of the bottom section, and wherein the fifth interfacing feature of the extension section comprises a first recess in a third engagement surface of the extension section that is configured to receive the first protrusion.

15. The system of claim 14, wherein the sixth interfacing feature of the extension section comprises a second protrusion fixedly attached to and extending from a fourth engagement surface of the extension section, and wherein the second interfacing feature of the top section comprises a second recess in a second engagement surface of the top section that is configured to receive the second protrusion.

16. The system of claim 15, wherein the first protrusion extending from the first engagement surface of the bottom section has a rectangular cross-section, wherein the second protrusion extending from the fourth engagement surface of the extension section has a rectangular cross-section, wherein the first protrusion of the bottom section extends through the third engagement surface of the extension section, and wherein the second protrusion of the extension section extends through the second engagement surface of the top section.

17. A method for conducting subterranean operations, comprising:

installing a pipe handling system proximate a first rig; and adjusting a length of a ramp of the pipe handling system to accommodate a height of a first rig floor of the first rig by installing one or more extension sections of the ramp between a bottom section of the ramp and a top section of the ramp, wherein installing the one or more extension sections comprises inserting a plurality of differing protruding interfacing features extending from a first engagement surface into a plurality of differing recess interfacing features formed in a second engagement surface opposite the first engagement surface, wherein the inserting the plurality of differing protruding interfacing features into the plurality of different recess interfacing features aligns the one or more extension sections with either one of the bottom section or the top section.

18. The method of claim 17, wherein the ramp guides an end of a pipe carrier to or from the first rig floor, and wherein the pipe carrier is configured to transfer a pipe between a horizontal storage location and the first rig floor.

19. The method of claim 17, further comprising:

moving the pipe handling system from the first rig to proximate a second rig; and adjusting a length of a ramp of the pipe handling system to accommodate a height of a second rig floor of the second rig by installing or removing the one or more extension sections of the ramp between the bottom section of the ramp and the top section of the ramp, wherein a height from the ground to the second rig floor is different than a height from the ground to the first rig floor.

* * * * *